US007771033B2

(12) United States Patent
Stathem

(10) Patent No.: US 7,771,033 B2
(45) Date of Patent: Aug. 10, 2010

(54) PRINTING DEVICE

(75) Inventor: Ralph L. Stathem, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 846 days.

(21) Appl. No.: 11/708,095

(22) Filed: Feb. 16, 2007

(65) Prior Publication Data

US 2008/0198206 A1 Aug. 21, 2008

(51) Int. Cl.
*B41J 2/175* (2006.01)
*B41J 2/195* (2006.01)

(52) U.S. Cl. ..... 347/86; 347/7

(58) Field of Classification Search ..... 347/7, 347/85, 86
See application file for complete search history.

(56) References Cited

U.S. PATENT DOCUMENTS 4,931,812 A * 6/1990 Dunn et al. ..... 347/87
4,967,207 A 10/1990 Ruder
6,053,604 A 4/2000 Sato
6,158,848 A 12/2000 Liu
6,929,357 B2 8/2005 Qingguo
7,114,801 B2 10/2006 Hall
2002/0063759 A1 5/2002 Hirano
2004/0150699 A1 8/2004 Feliciano
2006/0001717 A1 1/2006 Sasaki

FOREIGN PATENT DOCUMENTS

EP 0870618 10/1998
EP 0906830 A2 4/1999

OTHER PUBLICATIONS

International Search Report for Application No. PCT/US2008/053148. Report issued May 29, 2008.
Supplementary European Search Report for Application No. EP 08 72 9135. Feb. 12, 2010.

* cited by examiner

*Primary Examiner*—Stephen D Meier
*Assistant Examiner*—Geoffrey Mruk

(57) ABSTRACT

Various ink containers are provided. One exemplary ink container includes a housing that is configured to hold ink therein and has an ink fill port and a gas exit port. A single sealing device is compressively held by a portion of the housing so as to obstruct both the ink fill port and the gas exit port.

13 Claims, 1 Drawing Sheet

PRINTING DEVICE

BACKGROUND

Printing devices including ink containers, such as ink cartridges, may include air trapped therein after an ink filling process. It may be desirable to provide an ink container that reduces air trapped therein.

DETAILED DESCRIPTION OF THE DRAWINGS

Figure 1:
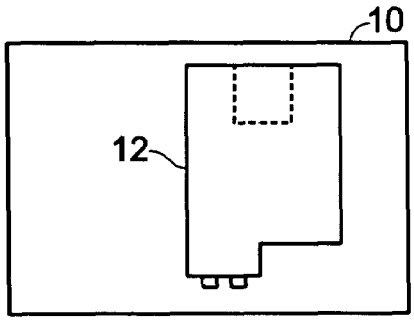
FIG. 1 is a schematic view of one example embodiment of a printing device including an ink container.

FIG. 1 shows a schematic view of one example embodiment of a printing device 10 including an ink container 12 therein. Ink container 12 may be an ink cartridge that holds ink and prints ink therefrom. In another embodiment, ink container 12 may be an ink tank connected to an ink printhead. In other embodiments, other types of ink containers 12 may be utilized.

Figure 2:
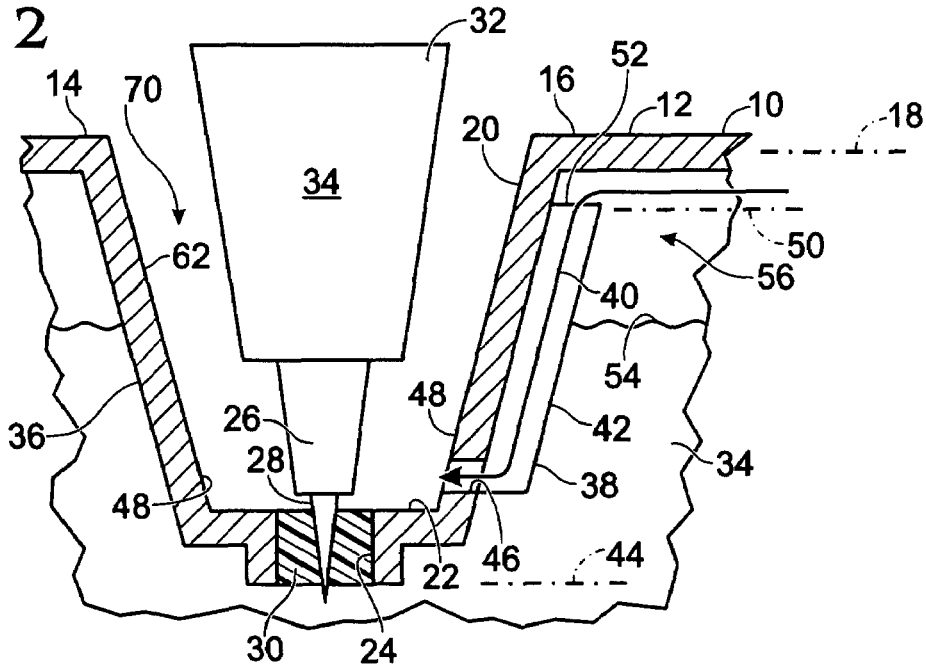
FIG. 2 is a partial side cross sectional view of one example embodiment of an ink container of the printing device of FIG. 1 during placement of ink therein.

FIG. 2 is a partial side cross sectional view of one example embodiment of an ink container 12 of the printing device 10 of FIG. 1 during placement of ink therein. Ink container 12 may include a housing 14 that includes a top surface 16. Top surface 16 may define a top surface plane 18 of ink container 12. For purposes of the present disclosure, the directional terms "top," "bottom," "up," "down," and the like are used merely for ease of illustration. In other embodiments the components of the device described may be positioned in different orientations.

Top surface 16 may include a downwardly extending recess 20, which in the embodiment shown may define a downwardly extending, truncated cone. Recess 20 may include a lower surface 22 that may include an ink inlet port 24, such as an aperture. Inlet port 24 may be sized to receive an ink fill nozzle 26 therein. In the embodiment shown, nozzle 26 may include a needle 28 and ink inlet port 24 may include a septum 30. Septum 30 may be manufactured of a flexible, elastic material, such as rubber, that may be adapted to allow the passage of needle 28 therethrough. Nozzle 26 may be positioned on an ink fill vessel 32 such that ink 34 may be filled into a cavity 36 of ink container 12, though needle 28 which is positioned through septum 30 of ink inlet port 24.

Ink container 12 may further include a gas exit port 38, which may also be referred to as a vent, that may define a gas exit pathway 40 from cavity 36. Gas exit port 38 may include a wall 42, which may be referred to as a baffle, that may extend from a position close to top surface 16 of ink container 12 and may extend downwardly toward a plane 44 defined by ink inlet port 24. In one embodiment, ink container 12 may be molded as an integral unit, including wall 42, downwardly extending recess 20, and top surface 16. Gas exit port 38 may terminate in a gas exit outlet 46 positioned within a lower region 48 of downwardly extending recess 20. Wall 42 may define an gas exit pathway 40 that is enclosed along its length such that ink 34 positioned within cavity 36 does not enter gas exit pathway 40 until the ink 34 rises to a level of a plane 50, defined by a topmost edge 52 of wall 42. In the embodiment shown, pathway 40 defines a tubular pathway, enclosed along its length and open at its entrance at plane 50 and open at its exit 38 within downwardly extending recess 20. Plane 50, defined by topmost edge 52 of wall 42, in the embodiment disclosed, is positioned above plane 44 defined by ink inlet port 24, and close to top surface 16 of ink container 12. Accordingly, cavity 36 may be filled with ink 34 to an ink level 54 that is positioned above plane 44 defined by ink inlet port 24. At a full capacity, ink cavity 36 may be filled with ink 34 up to an ink level 54 that is positioned at plane 50 defined by topmost edge 52 of wall 42 (see FIG. 3). Accordingly, gas exit port 38, which defines gas exit pathway 40 extending downwardly from a position below plane 18 of top surface 16, to a gas exit outlet 46 within lower region 48 of downwardly extending recess 20, allows a reduced amount of gas 56 to be trapped within ink container 12 after supplying ink thereto. In other words, a height 64 of a gas containing region 66 of a filled ink container 12 (see FIG. 3) may be much smaller than a height 68 from inlet port 24 to top surface 16, which may be the height of a gas containing region in an ink container that does not include gas exit port 38.

Figure 3:
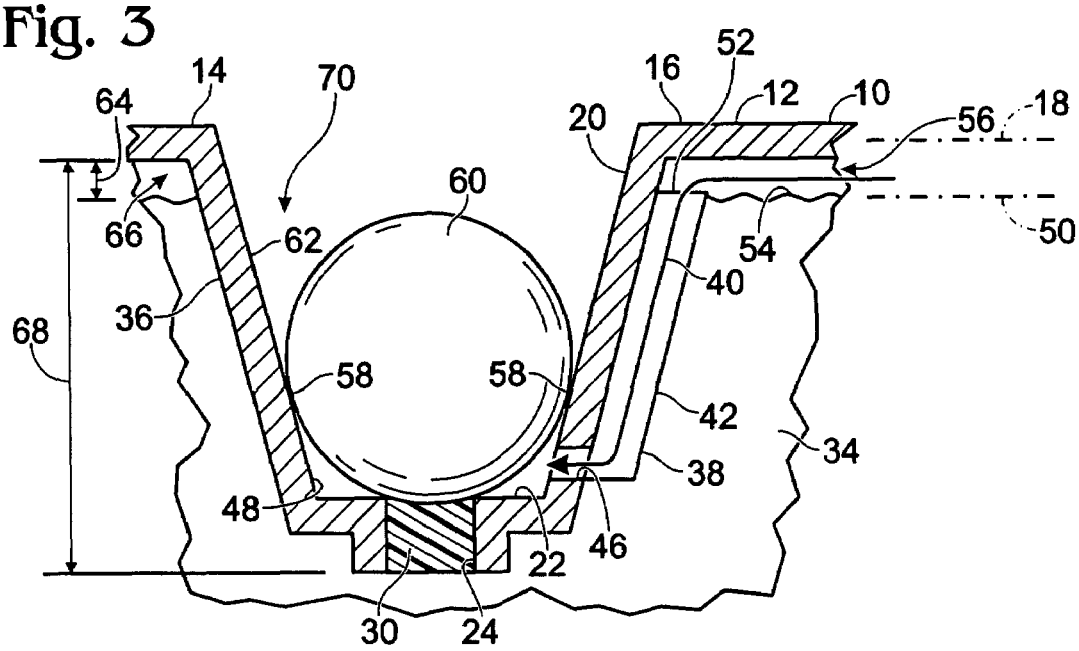
FIG. 3 is a partial side cross sectional view of one example embodiment of an ink container of the printing device of FIG. 1 after sealing thereof.

FIG. 3 is a partial side cross sectional view of one example embodiment of an ink container 12 of the printing device 10 of FIG. 1 after filling and sealing thereof. As shown in this figure, ink inlet port 24 and gas exit port 46 may both be positioned within lower region 48 of downwardly extending recess 20, below a line of contact 58 (shown as two points of contact in the cross sectional view of FIG. 3) of a sealing member 60 with a wall 62 of recess 20. Accordingly, after filling of ink 34 into cavity 36, up to an ink level 54, such as a level aligned with plane 50 of topmost edge 52 of wall 42, sealing member 60, such as a ball, may be frictionally secured within recess 20. Sealing member 60 may define an airtight line of contact 58 such that lowermost region 48 of recess 20 may be sealed from an exterior environment 70 of ink container 12. A single sealing member 60, therefore, may be utilized in some embodiments to seal both ink inlet port 24 and gas exit outlet 46.

The ink container 12 of the present invention may include several advantages. Ink container 12 may be filled to an ink level 54 positioned higher than a plane 44 of ink inlet port 24, thereby increasing the ink fill capacity of ink container 12. Filling ink container 12 to an ink level 54 positioned higher than plane 44 of ink let port 24 may also reduce air 56 trapped within cavity 36, which may increase the quality of the printing experience. Positioning of ink inlet port 24 and gas exit outlet 46 such that they are both positioned within a single downwardly extending recess 20, may reduce manufacturing costs of ink container 12. Positioning of ink inlet port 24 and gas exit outlet 46 such that they may both be sealed by a single sealing member 60, may reduce the cost of filling and/or sealing of ink container 12. A downwardly extending gas pathway 40 allows a reduced gas space 56 within filled cavity 36 while positioning sealing member 60 downwardly from top surface 16 of ink container 12.

A method of venting an ink container 12 during ink filling will now be described. Ink 34 is supplied to enclosed ink receiving cavity 36 through ink inlet port 24, which is positioned downwardly from top surface 16 of said ink receiving cavity top surface 16. Ink receiving cavity 36 is vented through gas exit port 38, wherein the gas enters gas exit pathway 40 at a position upwardly of ink inlet port 24, and exits pathway 40 at gas exit outlet 46, positioned below top surface 16. This allows filling of cavity 36 up to a level of the topmost edge 52 of wall 42 of gas exit pathway 40. The gas exit outlet 38 and the ink inlet port 24 are then sealed with a single sealing device 60 frictionally secured with downwardly extending recess 20.

In another embodiment, device 10 may include two downwardly extending recesses 20, wherein ink inlet port 24 is positioned within one recess and gas exit port 38 is positioned within another recess. In such an embodiment, a separate sealing member 60 may be utilized to seal each of ink inlet port 24 and gas exit port 38. Such an embodiment may allow sealing of gas exit port prior to sealing of ink inlet port 24.

Other variations and modifications of the concepts described herein may be utilized and fall within the scope of the claims below.

I claim:

1. An ink container, comprising:

a top wall that encloses an ink receiving cavity having downwardly extending tapered side walls, wherein said top wall defines a top wall plane, and wherein said cavity has a bottom wall;

an ink fill port positioned in said bottom wall of said cavity, wherein said ink fill port extends downwardly from said top wall plane and into said cavity;

a gas exit port positioned in one of said side walls of said cavity, wherein said gas exit port defines a gas exit path from said cavity, said gas exit path extending from a position upwardly of said ink fill port and thereafter downwardly from said top wall plane; and a ball positioned in said tapered cavity, wherein said ball prevents the flow of ink and gas through both said ink fill port and said gas exit port, respectively, during printing.

2. The container of claim 1 wherein said ink fill port and said gas exit port are both sealed by a single sealing device.

3. The container of claim 1 wherein said ink container comprises an ink cartridge.

4. The container of claim 3 wherein said gas exit aperture and said ink fill port are both positioned below a line of contact of said ball with said wall.

5. The container of claim 1 wherein said gas exit path defines an ink fill level within said cavity, said ink fill level positioned closer than said ink fill port to said top wall plane.

6. The container of claim 1 wherein said gas exit port defines a gas exit aperture positioned below said top wall plane.

7. An ink container, comprising:

a housing configured to hold ink therein, the housing forming a tapered cavity having a side wall and a bottom wall connected thereto, wherein said bottom wall includes an ink fill port and said side wall includes a gas exit port; and a single sealing device compressively held by a portion of said housing in a position wherein the sealing device prevents the flow of ink and gas through both said ink fill port and gas exit ports, respectively, during printing.

8. The ink container of claim 7, wherein said ink fill port and said gas exit port are positioned adjacent one another, and wherein the single sealing device is inserted into a feature formed by the housing.

9. The ink container of claim 8, wherein the feature is a recessed feature and the ink fill port and the gas exit port open into the recessed feature.

10. The ink container of claim 7, wherein the single sealing device fluidically isolates the sealed ink fill port from the sealed gas exit port.

11. The ink container of claim 7, wherein the sealing device has at least one curved surface.

12. The ink container of claim 11, wherein the sealing device has a spherical shape.

13. The ink container of claim 7, wherein the ink fill port includes a septum.

* * * * *